United States Patent [19]

Neville

[11] 4,352,667

[45] Oct. 5, 1982

[54] RIGGER FOR A ROWING OR SCULLING BOAT

[76] Inventor: Leonard H. Neville, 3, Toutley Close, Wokingham, Berkshire, RG11 1JH, England

[21] Appl. No.: 241,303

[22] Filed: Mar. 6, 1981

[30] Foreign Application Priority Data

Mar. 7, 1980 [GB] United Kingdom ..... 8007828

[51] Int. Cl.[3] ..... B63H 16/06

[52] U.S. Cl. ..... 440/105

[58] Field of Search ..... 440/104, 105, 106, 107, 440/108, 109, 110; 416/74; 9/1.7

[56] References Cited

U.S. PATENT DOCUMENTS

| | | | |
|---|---|---|---|
| 271,441 | 1/1883 | Fearon | 440/105 |
| 1,223,512 | 4/1917 | Neville | 440/105 |
| 1,488,836 | 4/1924 | Rollins | 440/105 |

FOREIGN PATENT DOCUMENTS

| | | | |
|---|---|---|---|
| 2301436 | 10/1976 | France | 440/105 |

*Primary Examiner*—Trygve M. Blix

*Assistant Examiner*—Jesús D. Sotelo

*Attorney, Agent, or Firm*—Cullen, Sloman, Cantor, Grauer, Scott & Rutherford

[57] ABSTRACT

A rigger for a rowing or sculling boat, the rigger comprising at least two stays the inner ends of which are securable to the saxboard of a boat and the outer ends of which converge towards one another and are secured together, a rowlock, and mounting element for the rowlock, the mounting element comprising a hollow tubular member secured to the outer end of at least one the stay so that its longitudinal axis extends laterally of the boat when the rigger is in use, a bracket member, an element mounting the bracket member on the tubular member so that the bracket member can be adjusted relative to the tubular member longitudinally of the tubular member, angularly about the longitudinal axis of the tubular member and angularly about an axis at right angles to the longitudinal axis of the tubular member, and a vertically extending pin carried by the bracket member, the rowlock being mounted on the pin and being adjustable relative to the bracket member in the longitudinal direction of the pin.

12 Claims, 2 Drawing Figures

RIGGER FOR A ROWING OR SCULLING BOAT

This invention relates to riggers for rowing or sculling boats.

Rowing or sculling boats, such as racing shells, used for sports or competition purposes are generally very narrow in the beam as compared with their length and it is conventional to mount the rowlocks outboard of the boat on laterally extending riggers. Such riggers generally each comprise a plurality of stays, e.g., two or three stays, one end of each of which is securable to the saxboard of the boat and the other ends of which converge towards and are secured to a mounting for a pin which extends in a generally vertical direction in the position of use of the rigger and which carries the rowlock.

To meet the requirements of persons of different physique and of different techique it is desirable that the rowlock be adjustable for height above the water, for span, i.e., lateral distance from a boat on which the rigger is mounted, for fore and aft pitch, i.e., angular adjustment of the axis of said pin which carries the rowlock with respect to the vertical in a vertical plane parallel to the longitudinal axis of the boat, and for lateral pitch, i.e., angular adjustment of the axis of said pin with respect to the vertical in a vertical plane extending laterally of the longitudinal axis of the boat.

The present invention has as its object to provide a rigger for a rowing or sculling boat which can be of simple and robust construction and which will permit of all the aforesaid adjustments.

The present invention provides a rigger for a rowing or sculling boat, the rigger comprising at least two stays having inner ends securable to the saxboard of a boat and outer ends which converge towards one another and are secured together, a rowlock, and mounting means for the rowlock, said mounting means comprising a hollow tubular member secured to the outer end of at least one of said stays so that its longitudinal axis will extend substantially laterally of the boat when the rigger is in use on a boat, a bracket member, means mounting said bracket member on said tubular member so that the bracket member can be adjusted relative to the tubular member longitudinally of the tubular member, angularly about the longitudinal axis of the tubular member and angularly about an axis at right angles to the longitudinal axis of the tubular member, and a pin carried by said bracket member so that in the position of use of the rigger, the longitudinal axis thereof will extend in a generally vertical direction, said rowlock being mounted on said pin and being adjustable relative to said bracket in the longitudinal direction of the pin.

Figure 1:
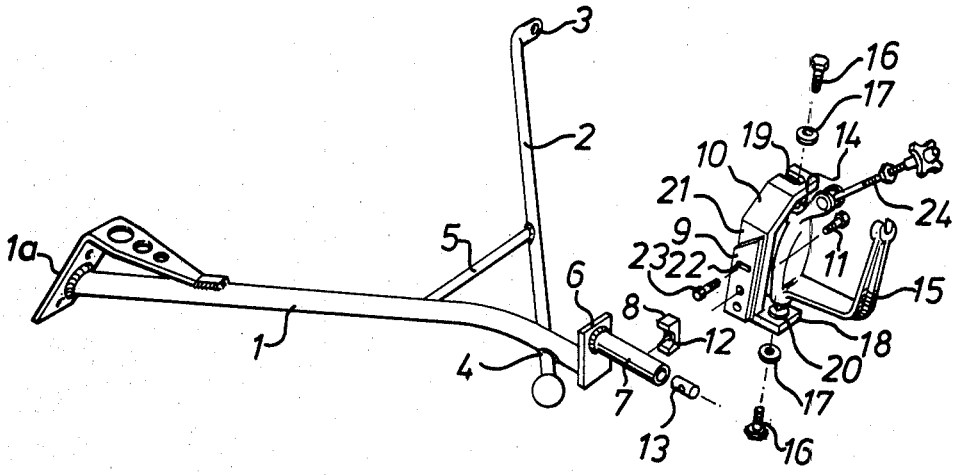
Figure 2:
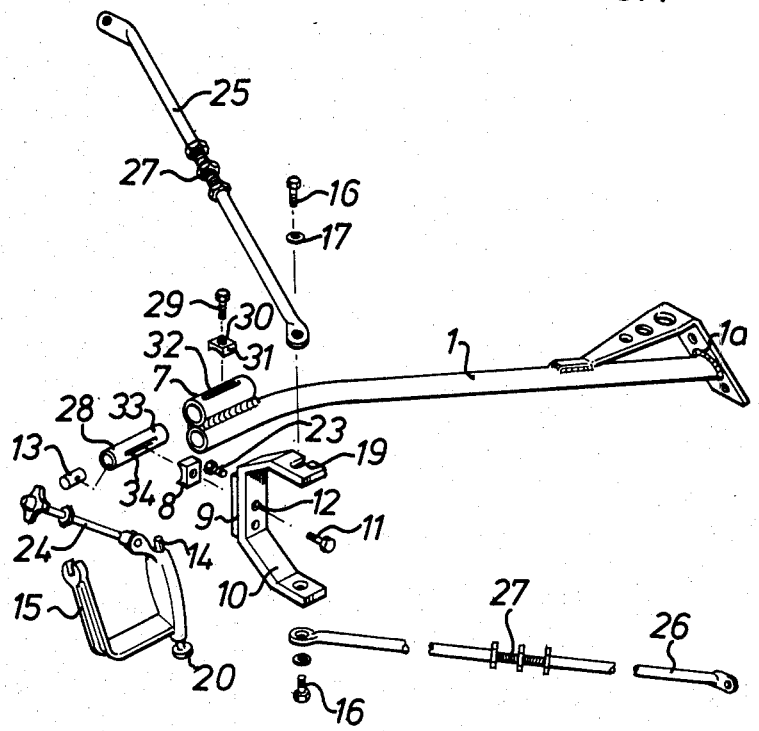

The invention will be more particularly described with reference to the accompanying drawings, in which:

FIG. 1 is an exploded perspective view of one embodiment of a rigger according to the present invention suitable for use on a sculling boat, and FIG. 2 is an exploded perspective view of another embodiment of a rigger according to the present invention suitable for use on a rowing boat.

Referring to FIG. 1 of the drawings it will be seen that the rigger illustrated therein comprises two stays 1, 2 of hollow tubular metal such as aluminium, stainless steel or mild steel. The stay 1 has a mounting bracket 1*a* welded to the inner end thereof whereby it can be secured, e.g., bolted, to the saxboard of a boat whilst the inner end of the stay 2 has an aperture 3 therein whereby it also can be secured, e.g., bolted, to the saxboard of a boat. The outer ends of the stays 1 and 2 converge and are secured to one another as by a weld 4. A cross brace 5 extends between and is welded to the stays 1,2.

Secured to the outer end of the stay 1 is a plate 6 to which a hollow tubular member 7 is secured so that its longitudinal axis will extend substantially laterally of a boat on which the rigger is mounted when the rigger is in use. Said tubular member 7 has a longitudinally extending slot (not shown) in the peripheral wall thereof.

Mounted on the tubular member 7 by way of a saddle member 8 and an indicator member 9 (the purpose of which will be described hereinafter) is a substantially C-shaped bracket member 10. The bracket member 10 is secured to the tubular member 7 by a bolt 11 which passes through aligned apertures 12 in the bracket member 10, indicator member 9 and saddle member 8, then through said slot in the tubular member 7 and makes threaded engagement with a cylindrical nut 13 housed within the tubular member 7. The slot in the tubular member 7 has a width greater than the diameter of the bolt 11, e.g., has a width equal to about one and a half times the diameter of the bolt 11. Thus when the bolt 11 is loosed slightly the bracket member 10 can be adjusted relative to the tubular member 7 either longitudinally of the tubular member 7 by moving the bolt 11 along the slot in the tubular member 7, angularly about the axis of the tubular member 7 by an amount limited by the width of the slot in the tubular member 7 or angularly about the axis of the bolt 11.

Mounted in the bracket member 10 so that in the position of use of the rigger its axis will extend in a generally vertical direction is a pin 14 on which is mounted a rowlock 15. The pin 14 is mounted in the bracket member 10 by means of bolts 16 and washers 17, the bolts 16 passing one through an aperture in a laterally extending flange 18 of the bracket member 10 and the other through a slot 19 in the bracket member 10 and making threaded engagement with screw-threaded bores in the ends of the pin 14. The rowlock 15 can be adjusted longitudinally of the pin 14 by positioning washers 20 (only one of which is shown) on the pin between the rowlock 15 and the bracket member 10 either above or below the rowlock.

The indicator member 9 is secured, e.g., welded, to the saddle member 8 so that when the bracket member 10 is angularly adjusted about the axis of the bolt 11 it will move angularly relative to the indicator member 9 and the angular disposition thereof relative to the indicator member 9 will be indicated on a scale 21 marked on the bracket member 10. To limit the angular movement of the bracket member 10 about the axis of the bolt 11 a slot 22 is provided in the indicator member 9 and a bolt 23 is provided which passes through said slot 22 and makes threaded engagement with a threaded aperture in the bracket member 10.

The rowlock 15 has a releasable strap 24 for retaining an oar therein in conventional manner.

From the foregoing it will be readily understood that the rowlock 15 can be adjusted for height above the water by suitably positioning the washers 20 on the pin 14 either above or below the rowlock 15, for span by moving the bracket member 10 longitudinally with respect to the tubular member 7, for fore and aft pitch by adjusting the bracket member 10 angularly about the axis of the tubular member 7 and for lateral pitch by adjusting the bracket member 10 angularly about the axis of the bolt 11. Moreover, all but the height adjustment are achieved simply by loosening the one bolt 11 and suitably adjusting the bracket member 10 relative to the tubular member 7.

In a modification of the embodiment of FIG. 1 the outer end of the stay 1 is secured, e.g., welded, to the outer end of the tubular member 7 instead of to the stay 2 as shown. In this way the tubular member 7 is supported at both ends and a stronger structure is obtained. Also, if desired, the saddle member 8 can be replaced by a collar member slidable on the tubular member 7 and having an aperture therein for the passage of the bolt 11.

The rigger illustrated in FIG. 2 is similar to that shown in FIG. 1 and like parts have been given like reference numerals. The only differences between the riggers of FIGS. 1 and 2 are that in the rigger of FIG. 2 the stay 2 has been replaced by a pair of stays 25, 26 which are adjustable for length by means of screw adjustors 27 and the outer ends of which are secured to the pin 14 by means of the bolts 16, that the tubular member 7 is secured, e.g., welded, piggyback fashion on the stay 1, and that the bracket member 10 is mounted on a tubular member 28 which makes telescopic engagement with the tubular member 7.

The tubular member 28 is secured in the tubular member 7 by means of a bolt 29 which passes through an aperture 30 in a saddle member 31 and through a longitudinally extending slot 32 in the top of the tubular member 7 and which makes threaded engagement with an aperture 33 in the tubular member 28. The tubular member 28 has a longitudinally extending slot 34 therein through which the bolt 11 passes. This arrangement gives a greater degree of span adjustment by virtue of the slots 32 and 34 and this is desirable with boats such as those known as "eights", i.e., adapted to accommodate eight oarsmen one behind the other, wherein the beam of the boat varies quite considerably between the mid-section and the fore and aft rowing positions since it enables riggers of a single standard size to be provided at all rowing positions along the length of the boat whereas in the past it has been necessary to have riggers with longer stays at the fore and aft rowing positions.

The fore and aft pitch adjustment can be obtained either by making the slot 32 in the tubular member 7 wider than the diameter of the bolt 29 and/or by making the slot 34 in the tubular member 28 wider than the diameter of the bolt 11.

I claim:

1. A rigger for a rowing or sculling boat, the rigger comprising at least two stays having inner ends securable to the saxboard of a boat and outer ends which converge towards one another and are secured together, a rowlock, and mounting means for the rowlock, said mounting means comprising:

(a) a hollow tubular member secured to the outer end of at least one of said stays so that its longitudinal axis will extend substantially laterally of the boat when the rigger is in use on a boat, (b) a bracket member, (c) means mounting said bracket member on said tubular member so that the bracket member can be adjusted relative to the tubular member longitudinally of the tubular member, angularly about the longitudinal axis of the tubular member and angularly about an axis at right angles to the longitudinal axis of the tubular member, and (d) a pin carried by said bracket member so that, in the position of use of the rigger, the longitudinal axis thereof will extend in a generally vertical direction, (e) said rowlock being mounted on said pin and being adjustable relative to said bracket member in the longitudinal direction of the pin.

2. A rigger according to claim 1, wherein said at least one stay has a plate secured to the outer end thereof which carries said tubular member.

3. A rigger according to claim 1, wherein said tubular member is parallel with an end portion of said at least one stay and is secured piggyback fashion on said end portion.

4. A rigger according to claim 1, wherein said tubular member has a longitudinally extending slot therein, said bracket member being mounted on said tubular member by screw means passing through said slot whereby to enable the bracket member to be adjusted longitudinally of the tubular member and angularly about an axis provided by the screw means.

5. a rigger according to claim 4, wherein said slot has a width greater than the diameter of said screw means whereby to enable limited adjustment of said bracket member angularly about the longitudinal axis of the tubular member.

6. A rigger according to claim 5, wherein said slot has a width equal to about one and a half times the diameter of the screw means.

7. A rigger according to claim 4, wherein a saddle member is provided which is interposed between said tubular member and said bracket member, said saddle member having a part-cylindrical surface thereon which partially embraces the outer surface of the tubular member.

8. A rigger according to claim 7, wherein said saddle member has an indicator member secured thereto which cooperates with a scale provided on said bracket member to indicate the angular position of the bracket member relative to the indicator member.

9. A rigger according to claim 1, wherein said tubular member comprises two hollow tubular sections which are in telescopic engagement and which can be telescopically adjusted to move said bracket member longitudinally of the tubular member.

10. A rigger according to claim 9, wherein said telescopic sections are secured together by screw means which passes through a longitudinally extending slot in one of said sections and which engages an aperture in the other of said sections.

11. A rigger according to claim 10, wherein said slot is of greater width than said screw means so as to permit limited relative angular adjustment between said sections.

12. A rigger according to claim 1, wherein said bracket is substantially C-shaped, said pin extending between the arms thereof and being secured thereto by releasable screw means, and wherein a plurality of washers are provided on said pin which can be positioned between the bracket member and the rowlock on either one side or the other of the rowlock to adjust the rowlock longitudinally of the pin.

* * * * *